US006422119B1

(12) United States Patent
Boss

(10) Patent No.: US 6,422,119 B1
(45) Date of Patent: Jul. 23, 2002

(54) METHOD AND DEVICE FOR TRANSFERRING INFORMATION TO PROGRAMMABLE PROJECTILES

(75) Inventor: André Boss, Zurich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/414,308

(22) Filed: Oct. 6, 1999

(30) Foreign Application Priority Data

Oct. 8, 1998 (CH) ..... 2033/98

(51) Int. Cl.[7] ..... F42C 9/00

(52) U.S. Cl. ..... 89/6.5; 235/408

(58) Field of Search ..... 89/6.5, 1.816; 73/167, 417; 102/264, 293, 206, 427, 218; 235/408

(56) References Cited

U.S. PATENT DOCUMENTS

| | | | | |
|---|---|---|---|---|
| 2,415,362 | A | | 2/1947 | Midgley et al. |
| 3,500,746 | A | * | 3/1970 | Ambrosini |
| 3,955,069 | A | * | 5/1976 | Ziemba |
| 4,142,442 | A | * | 3/1979 | Tuten |
| 4,267,776 | A | * | 5/1981 | Eickerman |
| 4,283,989 | A | * | 8/1981 | Toulios |
| 4,649,796 | A | * | 3/1987 | Schmidt |
| 4,664,013 | A | * | 5/1987 | Wegner et al. |
| 4,711,152 | A | * | 12/1987 | Fortunko |
| 4,750,423 | A | * | 6/1988 | Nagabhushan |
| 4,862,785 | A | * | 9/1989 | Ettel |
| 4,955,279 | A | * | 9/1990 | Nahrwold |
| 4,979,424 | A | * | 12/1990 | Becker et al. |
| 5,117,733 | A | * | 6/1992 | Fischer et al. |
| 5,265,539 | A | * | 11/1993 | Kurschner et al. |
| 5,343,795 | A | * | 9/1994 | Ziemba et al. |
| 5,413,029 | A | * | 5/1995 | Gent et al. |
| 5,497,704 | A | * | 3/1996 | Kurschner et al. |
| 5,814,755 | A | * | 9/1998 | Boss |
| 5,814,756 | A | * | 9/1998 | Boss |
| 5,827,958 | A | * | 10/1998 | Sigler |
| 5,834,675 | A | * | 11/1998 | Boss |

FOREIGN PATENT DOCUMENTS

| | | |
|---|---|---|
| EP | 0 082 445 A2 | 1/1985 |
| EP | 0 802 390 A1 | 9/1998 |
| EP | 0 802 392 | 9/1998 |
| EP | 0 802 391 A1 | 11/1998 |
| GB | 1 581 919 | 12/1980 |

* cited by examiner

*Primary Examiner*—Charles T. Jordan
*Assistant Examiner*—Troy Chambers
(74) *Attorney, Agent, or Firm*—Townsend and Townsend and Crew LLP; Guy W. Chambers

(57) ABSTRACT

The transmission of the disaggregation time takes place in the area of the conveying path of the projectiles (18) between a a magazine of the gun and the start of the flight path of the projectile (18), wherein the disaggregation time (Tz(Vo_typ)) is corrected by means of a delay time, which is a function of the selected transmitting point.

1 Claim, 3 Drawing Sheets

To Projectile
Measurement Information
Partial Ballistic Function
f(t,Vo_typ,Me,Elevation)
Tz (Vo_typ)
Tf
Vov
Dz
Me
Vm
Z
α
λ
1
3
4
5
6
7
9
11
12
18
19
40
41
42
Pf
Pz

METHOD AND DEVICE FOR TRANSFERRING INFORMATION TO PROGRAMMABLE PROJECTILES

FIELD OF THE INVENTION

The invention relates to a method and a device for transferring information to programmable projectiles, wherein at least a disaggregation time, which determines the time the projectile is disaggregated, is transmitted.

BACKGROUND OF THE INVENTION

A method and a device for calculating the disaggregation time of a programmable projectile, by means of which the impact probability of such projectiles can be improved, has become known from U.S. Pat. Nos. 5,814,755; 5,814,756 and 5,834,675. In this case the calculation is at a minimum based on an impact distance to a target object, a projectile velocity measured at the muzzle of a gun barrel, and a predetermined optimal disaggregation distance between an impact point of the target and a disaggregation point of the projectile. The optimal disaggregation distance provided is kept constant by means of correcting the disaggregation time of the projectile. Correction is performed in that a correcting factor, which is multiplied by a velocity difference, is added to the disaggregation time. The projectile velocity difference is formed from the difference between the actually measured projectile velocity and a lead velocity of the projectile, wherein the lead velocity is calculated from the average value of a number of previous successive projectile velocities.

With this device, the disaggregation time is inductively transmitted at the muzzle of the gun tube to the projectile when it passes there after having been fired, which can lead to transmission difficulties, for example in connection with magnetic projectiles of large caliber.

OBJECT AND SUMMARY OF THE INVENTION

The object of the invention is based on proposing a method of the type mentioned at the outset, which does not have the above mentioned disadvantages.

This object is attained by the transmission of the disaggregation time taking place in the area of the conveying path of a projectile between a magazine of a gun and the start of the flight path of the projectiles, wherein the disaggregation time is corrected by means of a delay time, which is a function of the selected transmission point.

In a particularly advantageous embodiment of the method, at least the correcting factor is transmitted, besides the disaggregation time.

In accordance with a further development of the invention, the information is transmitted at the shell magazine of the gun or ahead of it.

The advantages obtained by means of the invention are considered to be that additional information regarding the relative target/projectile geometry is provided to the projectile with the additional transmission of the correction factor. Because of the option of transmitting the information at any arbitrary point in the conveying path of the projectile, it is possible to select the most suitable and advantageous point.

The invention will be explained in greater detail in what follows by means of several exemplary embodiments and in connection with the drawings.

DETAILED DESCRIPTION OF THE PREFERRED EMBODIMENTS

Figure 1:
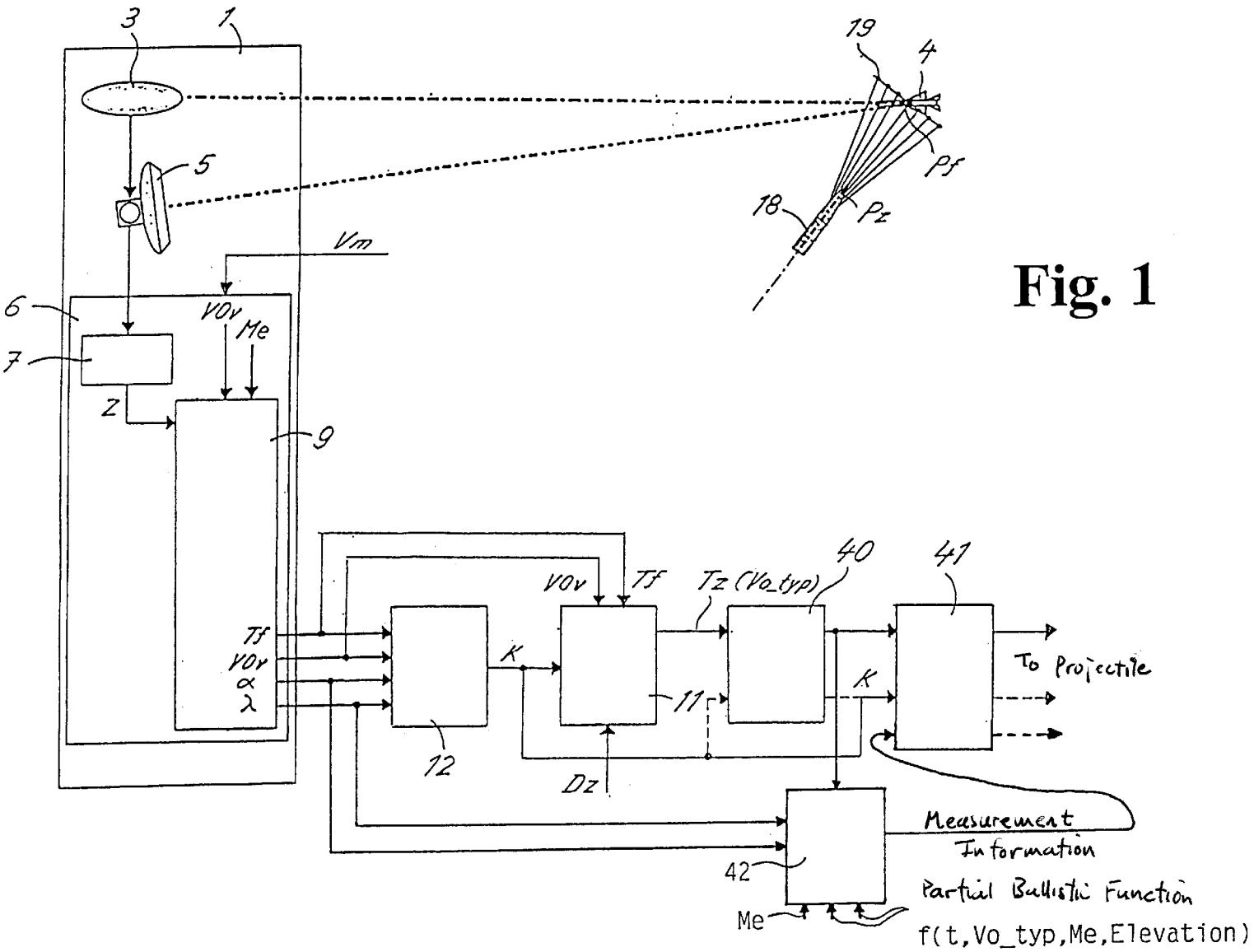
FIG. 1, a block circuit diagram of a device for transmitting the information in a first embodiment, FIG. 2, a block circuit diagram of the device in FIG. 1 in a second embodiment, and FIG. 3, a block circuit diagram of a device for transmitting the information in a third embodiment.

A firing control is identified by 1 in FIG. 1, which consists of a search sensor 3 for detecting a target 4, a tracking sensor 5, which is connected with the search sensor 3, for target acquisition, 3-D target tracking and 3-D target measuring, as well as a firing control computer 6. The firing control computer 6 has at least one main filter 7 and a lead computing unit 9. The main filter 7 is connected on the input side with the tracking sensor 5, and on the output side with the lead computing unit 9, wherein the main filter 7 passes on the 3-D target data received from the tracking sensor 5 to the lead computing unit 9 in the form of estimated target data Z, such as position, velocity, acceleration, etc. Meteorological data Me and actually measured projectile speed Vm can be supplied to the lead computing unit 9 via further inputs.

A projectile is identified by 18, which is represented at a disaggregation point Pz. The projectile 18 is a programmable projectile with primary and secondary ballistics, which is equipped with an ejecting charge and a time fuse and is filled with sub-projectiles 19.

A correcting computing unit 12 is connected on the input side with the lead computing unit 9, and on the output side with an update computing unit 11, the input side of which is also connected with the lead computing unit 9. A delay time adapter 40 in connected on the input side with the update computing unit 11, and on the output side with a transmitting device 41, whose input side is connected to the correcting computing unit 12. The transmitting device 41 operates inductively, or also galvanically or optronically, and can be arranged at any arbitrary point of the conveying path of the projectile 18 between a magazine of the gun and the start of the flight path of the projectiles, wherein the shell magazine of the gun is preferred. (It is understood that the shell taken from the shell magazine in a known manner consists of the projectile with a shell casing with an ejecting charge and a firing arrangement).

Reference numeral 42 identifies a further computing unit which calculates projectile data on the basis of a given partial ballistic function f(t,Vo_typ,Me,elevation), actual meteorological data (Me) and a measurement information, if this is necessary for an autonomous projectile measurement.

Figure 2:
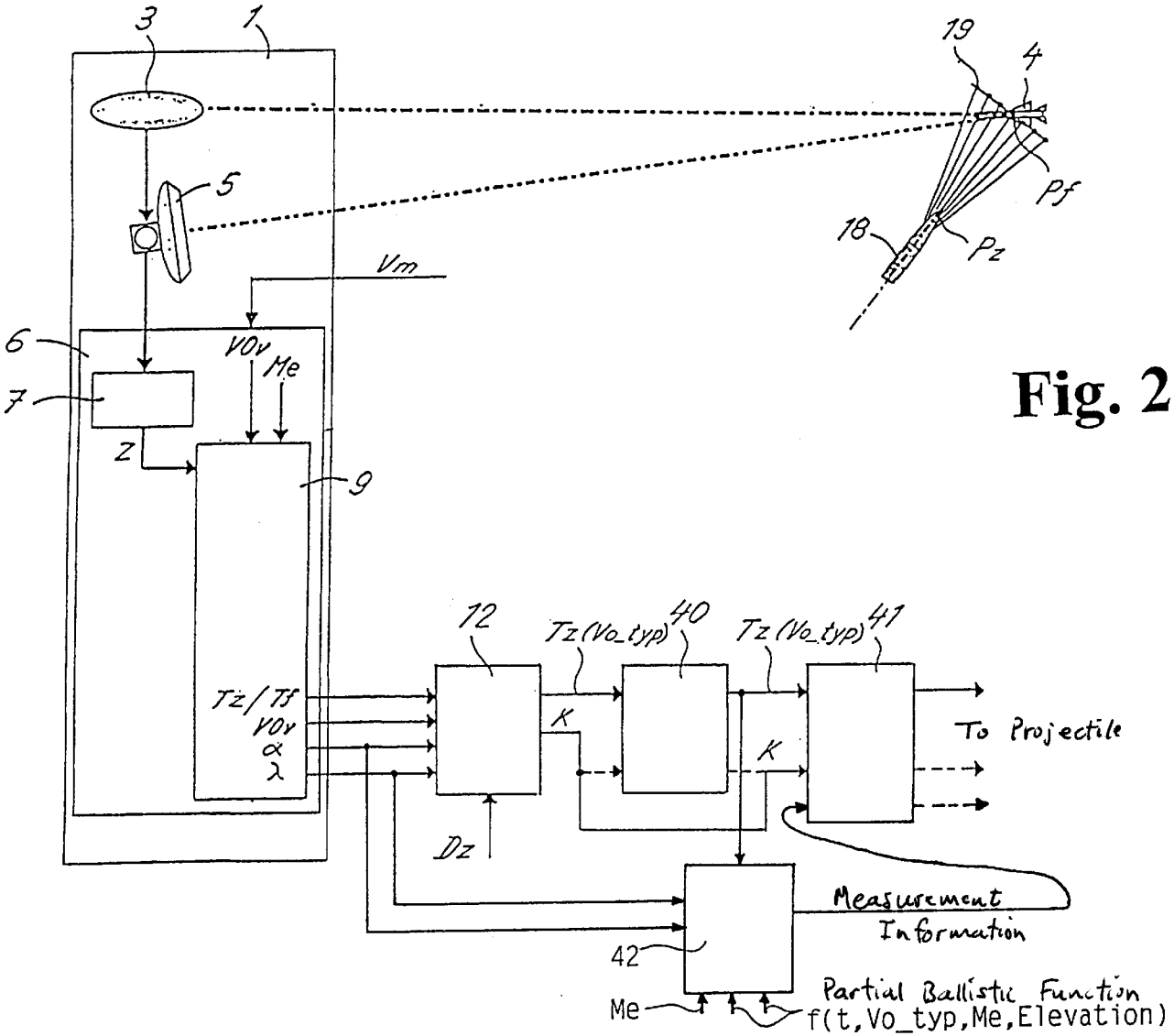

In accordance with FIG. 2, the update computing unit 11 is omitted, since its function is performed by the correcting computing unit 12.

Figure 3:
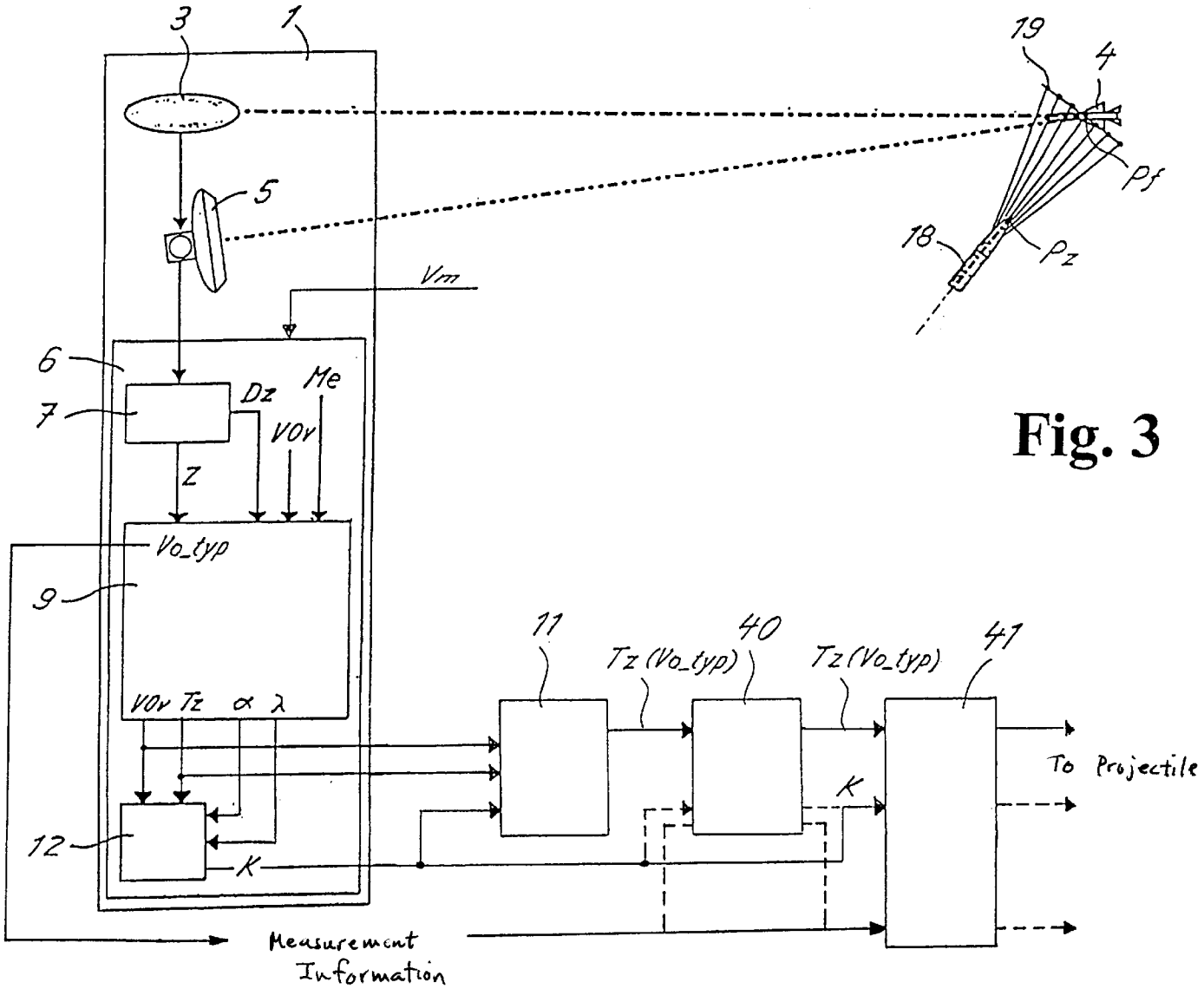

In FIG. 3 the correcting computing unit 12 is assigned to the firing control 1.

The meaning of the designations at the connections, or respectively junctions, can be seen from the following functional description.

As can be seen in the documents mentioned in the prior art, the lead computing unit 9 calculates an impact time Tf (FIGS. 1 and 2) from a lead velocity VOv and the target data Z, taking into consideration meteorological data Me. The lead computing unit 9 furthermore determines the gun angles $\alpha$ and $\lambda$. The values Tf, VOv, $\alpha$ and $\lambda$ are supplied to the correcting computing unit 12, in which a correction factor K is calculated from an equation known from the documents mentioned at the outset.

In accordance with FIG. 1, the lead velocity VOv, the correction factor K, the impact time Tf and a disaggregation distance Dz, which corresponds to the distance between the disaggregation point Pz and the impact point Pf, are entered into the update computing unit 11, and a corrected disaggregation time Tz(Vo_typ) is calculated from an equation known from the previously mentioned documents.

In accordance with FIG. 2, the disaggregation distance Dz is supplied to the correcting computing unit 12, and the correction factor K, as well as the corrected disaggregation time Tz(Vo_typ), are calculated there.

In FIG. 3, the disaggregation distance Dz is entered into the lead computing unit 9, so that the latter provides the disaggregation time Tz, instead of the impact time Tf, to the correcting computing unit 12. The lead velocity VOv, the disaggregation time Tz and the correction factor K are supplied to the update computing unit 11, wherein the corrected disaggregation time Tz(Vo_typ) is calculated.

The corrected disaggregation time Tz(Vo_typ) calculated in accordance with FIGS. 1, 2 and 3 is corrected in the delay time adapter 40, in which it is corrected by means of a delay time, which is a function of the position of the transmitting device 41. The disaggregation time Tz(Vo_typ) adapted in this way, and the correction factor K are supplied to the transmitting device 41 and transmitted to the programmable projectile 18, wherein the projectile 18 receives additional information regarding the target/projectile geometry together with the correction factor K.

It is also possible to adapt the correction factor K by means of the delay time adapter 40 (dashed lines in FIGS. 1 to 3).

What is claimed is:

1. An apparatus for transferring measurement information to a programmable projectile comprising:

a correcting computing unit for calculating a correction factor (K);

an update computing unit for receiving said correction factor (K) from said correcting computing unit and calculating corrected disaggregation time (Tz(Vo-typ)) measurement information using an average projectile lead velocity (VOv), said correction factor (K), an impact time (Tf) and a disaggregation distance (Dz);

a delay time adaptor for receiving said corrected disaggregation time (Tz(Vo-typ)) measurement information from said update computing unit and then further correcting it by calculating a delay time; and, a transmitting device, located between a magazine of a gun and the start of the flight path of the projectile, for transmitting said corrected disaggregation time (Tz(Vo-typ)) measurement information and said delay time received from said delay time adaptor to said programmable projectile when said programmable projectile is in motion.

* * * * *